US008212849B2

(12) United States Patent
Koroishi et al.

(10) Patent No.: US 8,212,849 B2
(45) Date of Patent: Jul. 3, 2012

(54) THERMAL HEAD, MANUFACTURING METHOD THEREFOR, AND PRINTER

(75) Inventors: Keitaro Koroishi, Chiba (JP); Toshimitsu Morooka, Chiba (JP); Noriyoshi Shoji, Chiba (JP); Norimitsu Sanbongi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 268 days.

(21) Appl. No.: 12/797,980

(22) Filed: Jun. 10, 2010

(65) Prior Publication Data

US 2011/0018952 A1 Jan. 27, 2011

(30) Foreign Application Priority Data

Jul. 21, 2009 (JP) ..... 2009-170383

(51) Int. Cl.
*B41J 2/335* (2006.01)

(52) U.S. Cl. ..... 347/202; 29/611

(58) Field of Classification Search ..... 347/200, 347/202; 29/611
See application file for complete search history.

(56) References Cited

U.S. PATENT DOCUMENTS 7,768,541 B2 * 8/2010 Koroishi et al. ..... 347/202
8,154,575 B2 * 4/2012 Koroishi et al. ..... 347/207

FOREIGN PATENT DOCUMENTS

JP 60-210469 A 10/1985
JP 06-340103 A 12/1994
JP 2007-083532 A 4/2007

* cited by examiner

*Primary Examiner* — Huan Tran
(74) *Attorney, Agent, or Firm* — Brinks Hofer Gilson & Lione

(57) ABSTRACT

There are provided a method of manufacturing a thermal head having a hollow portion at a position opposing a heating resistor, the manufacturing method assuring a sufficient strength to an upper plate substrate of the thermal head. The manufacturing method includes: processing a top surface of the upper plate substrate bonded to a support substrate to thin the upper plate substrate to a thickness T; wherein the processing comprises processing the top surface of the upper plate substrate so that a roughness Ra of the top surface of the upper plate substrate satisfies the following expression: $Ra \leqq \log_e(T^2)/(3\times10^6)+6.5\times10^{-6}$.

8 Claims, 6 Drawing Sheets

THERMAL HEAD, MANUFACTURING METHOD THEREFOR, AND PRINTER

RELATED APPLICATIONS

This application claims priority under 35 U.S.C. §119 to Japanese Patent Application No. 2009-170383 filed on Jul. 21, 2009, the entire content of which is hereby incorporated by reference.

BACKGROUND OF THE INVENTION

1. Field of the Invention

The present invention relates to a thermal head and a manufacturing method therefor, and a printer including the thermal head.

2. Description of the Related Art

There has been conventionally known a thermal head used in a thermal printer to effect printing onto a thermosensitive recording medium by selectively driving a plurality of heating elements based on printing data (see, for example, JP 2007-83532 A).

As a method for achieving a reduction in power consumption by improving thermal efficiency of a heating resistor in a thermal head, there has been known a method in which a hollow portion is formed in a region opposing the heating resistor. By allowing the hollow portion to function as a heat insulating layer having a low thermal conductivity, and reducing an amount of heat propagated and dissipated from the heating resistor to a support substrate, efficiency of energy used for printing may be improved.

Such a thermal head having a hollow portion is formed by providing a silicon substrate (lower plate substrate) with a concave portion by etching or laser processing, bonding a glass thin plate (upper plate substrate) serving as a heat accumulating layer onto the silicon substrate, and then processing the upper plate substrate to a desired thickness by polishing. Then, a heating resistor and wiring for power supply are formed on the upper plate substrate thus polished, and covered with a protective film, whereby the thermal head is formed.

For a conventional thermal head which does not have a hollow portion, methods are known which aim at preventing the separation of a protective film and a heating resistor from an upper plate substrate. One method involves adjusting the surface roughness Ra of the upper plate substrate to be 0.01 to 0.2 μm (10 to 200 nm) to improve the adhesion of the heating resistor (see, e.g., JP 60-210469 A). Another method involves adjusting the surface roughness of the upper plate substrate to be not less than 5 nm to improve the adhesion of the protective film (see, e.g., JP 06-340103 A).

However, in the thermal head having the hollow portion, the upper plate substrate is a glass plate as thin as 10 to 100 μm, and accordingly has a structure extremely weak to a force from above.

In general, it is said that the theoretical strength of glass is higher than that of iron. However, it has been known that, if there is a scratch or a defect in a surface of glass, a stress is concentrated thereon, and the strength of glass is reduced to about 1/10 to 1/100 times the theoretical strength.

In addition, the strength of glass decreases as the scratch is deeper and the number of scratches is larger so that the strength decreases as the surface roughness is larger. Accordingly, when the surface of a glass thin plate as the upper plate substrate is roughened to improve the adhesion of a film, a problem occurs that the resulting thermal head has an extremely low strength with respect to the concentrated stress.

SUMMARY OF THE INVENTION

The present invention has been made in view of the foregoing circumstances, and an object of the present invention is to provide a thermal head having a hollow portion at a position opposing a heating resistor, a manufacturing method therefor which may assure a sufficient strength to the upper plate substrate of the thermal head, and a printer.

In order to achieve the above-mentioned object, the present invention provides the following means.

A first aspect of the present invention provides a method of manufacturing a thermal head, including: forming an opening in at least one of a top surface of a support substrate having a flat-plate shape and a back surface of an upper plate substrate having a flat-plate shape; bonding the back surface of the upper plate substrate to the top surface of the support substrate formed with the opening so as to bring the upper plate substrate and the support substrate into stacked relation; processing a top surface of the upper plate substrate bonded to the support substrate to thin the upper plate substrate to a thickness T; and forming a heating resistor on a region of the processed top surface of the upper plate substrate which opposes the opening, in which the processing includes processing the top surface of the upper plate substrate so that a roughness Ra of the top surface of the upper plate substrate satisfies the following expression (1):

$$Ra \leq \log_e(T^2)/(3\times10^6)+6.5\times10^{-6} \quad (1).$$

According to the first aspect of the present invention, the opening is formed in the at least one of the top surface of the support substrate and the back surface of the upper plate substrate in an opening forming step, and the back surface of the upper plate substrate is bonded to the top surface of the support substrate in a bonding step so as to bring the upper plate substrate and the support substrate into stacked relation. Note that the opening may be a concave portion formed in one or both of the top surface of the support substrate and the back surface of the upper plate substrate, or a through hole formed in the top surface of the support substrate. In a surface processing step, the top surface of the upper plate substrate is processed to thin the upper plate substrate, and in a resistor forming step, the heating resistor is formed on the region of the top surface of the upper plate substrate opposing the opening. In this manner, the thermal head is manufactured which has a hollow portion at the position opposing the heating resistor and between the support substrate and the upper plate substrate.

When such a thermal head is used in, e.g., a printer, a load from a roller or the like is constantly applied to the upper plate substrate, and the pressure thereof is approximately 0.1 MPa. Moreover, when a hard and small foreign matter enters the gap between the roller and a sheet or between the sheet and the thermal head, a pressure several tens of times the normal pressure is applied to the upper plate substrate immediately below the foreign matter. Consequently, a stress is concentrated on a scratch or a defect in the top surface of the upper plate substrate, and may destroy the upper plate substrate.

Accordingly, the surface roughness Ra of the upper plate substrate which allows the upper plate substrate to withstand a pressure of 10 MPa was determined in consideration of a safety factor 100 times that for the normal pressure, which was within the range given by the foregoing expression (1).

Therefore, by processing the top surface of the upper plate substrate based on the foregoing expression (1) so as to provide the surface roughness in accordance with the thickness of the upper plate substrate in the surface processing step, the thermal head may be manufactured in which a predetermined strength (10 MPa) is assured even to upper plate substrates having various thicknesses.

The processing may include processing the top surface of the upper plate substrate to have a roughness which allows the heating resistor to be formed.

This allows the surface roughness and thickness of the upper plate substrate to be adjusted appropriately in the surface processing step. As a result, it is possible to improve the adhesion of the protective film and the heating resistor which are formed over the upper plate substrate, while ensuring the strength of the upper plate substrate.

The processing may include processing the top surface of the upper plate substrate to have a roughness of 0.1 nm or more and less than 5 nm.

By adjusting the surface roughness of the upper plate substrate to be less than 5 nm, the strength of the upper plate substrate may be ensured. Furthermore, by adjusting the surface roughness of the upper plate substrate to be not less than 0.1 nm, the adhesion of the protective film and the heating resistor which are formed over the top surface of the upper plate substrate may be improved.

The processing may include etching the upper plate substrate.

By etching the upper plate substrate in the surface processing step, the surface roughness and thickness of the upper plate substrate may be adjusted accurately.

The processing may include polishing the upper plate substrate.

By polishing the upper plate substrate in the surface processing step, the surface roughness and thickness of the upper plate substrate may be adjusted easily.

The forming a heating resistor may include forming the heating resistor in the region opposing the opening by sputtering.

In the resistor forming step, by forming the heating resistor on the top surface of the upper plate substrate by sputtering, the heating register may be formed even when the top surface of the upper plate substrate is relatively flat. This allows an improvement in the strength of the upper plate substrate.

A second aspect of the present invention provides a thermal head including: a support substrate having a flat-plate shape; an upper plate substrate having a flat-plate shape and a back surface bonded to a top surface of the support substrate; and a heating resistor formed on a top surface of the upper plate substrate, in which: at least one of the top surface of the support substrate and the back surface of the upper plate substrate has an opening formed on a region which opposes the heating resistor; and the top surface of the upper plate substrate is processed so that a roughness Ra of the top surface of the upper plate substrate satisfies the following expression (1) which is a function of a thickness T of the upper plate substrate:

$$Ra \leqq \log_e(T^2)/(3\times10^6)+6.5\times10^{-6} \quad (1).$$

The upper plate substrate formed with the heating register functions as a heat accumulating layer which accumulates therein heat generated from the heating resistor. Moreover, the opening formed in the at least one of the top surface of the support substrate and the back surface of the upper plate substrate forms a hollow portion between the support substrate and the upper plate substrate when the back surface of the upper plate substrate is bonded to the top surface of the support substrate. The hollow portion is formed in the region opposing the heating resistor, and functions as a heat insulating layer which shuts off heat generated from the heating resistor. Therefore, according to the second aspect of the present invention, it is possible to inhibit heat generated from the heating resistor from being propagated to the support substrate via the upper plate substrate and dissipated, and improve a use ratio of heat generated from the heating resistor, i.e., the thermal efficiency of the thermal head.

In such a thermal head, the top surface of the upper plate substrate is processed to satisfy the foregoing expression (1) so that a predetermined strength (10 MPa) may be assured.

A third aspect of the present invention provides a printer including the thermal head described above.

Such a printer includes the thermal head described above so that the thermal efficiency of the thermal head may be improved, and an amount of energy required for printing may be reduced. In addition, even when a foreign matter is trapped between a printed matter and the upper plate substrate, the upper plate substrate may be prevented from being broken.

According to the present invention, an effect is achieved that, in the thermal head having the hollow portion at the position opposing the heating resistor, a sufficient strength may be assured to the upper plate substrate.

DETAILED DESCRIPTION OF THE PREFERRED EMBODIMENTS

Figure 1:
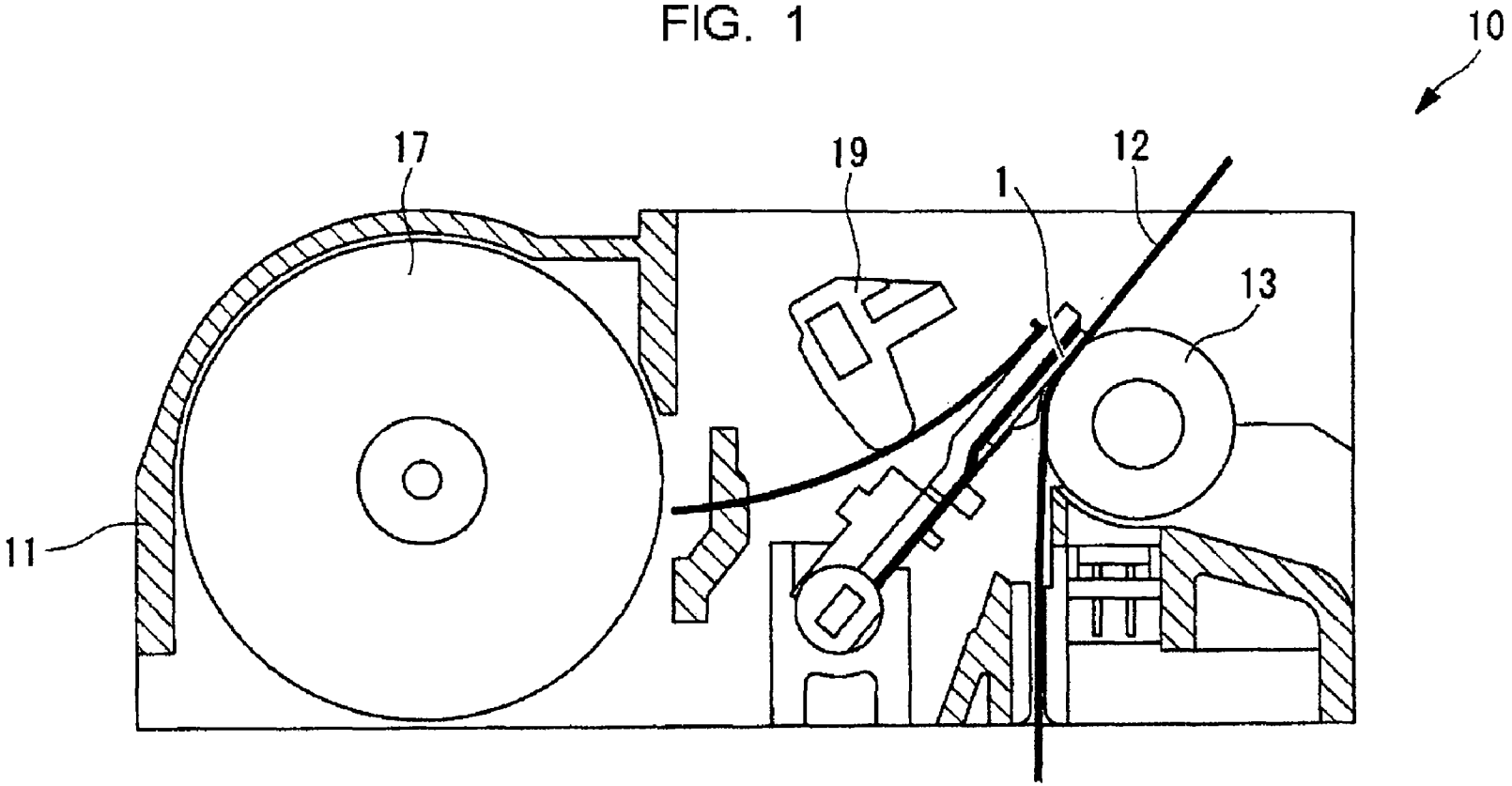
FIG. 1 is a schematic structural view of a thermal printer according to an embodiment of the present invention.

Referring to the drawings, a thermal head 1 and a thermal printer 10 according to an embodiment of the present invention are described.

The thermal head 1 according to this embodiment is used in the thermal printer 10 as illustrated in, for example, FIG. 1, and selectively drives a plurality of heating elements based on printing data to effect printing onto a printing target such as thermal paper 12 or the like.

The thermal printer 10 includes a main body frame 11, a platen roller 13 disposed horizontally, the thermal head 1 disposed oppositely to an outer peripheral surface of the platen roller 13, a heat dissipation plate 15 (see FIG. 3) supporting the thermal head 1, a paper feeding mechanism 17 for feeding the thermal paper 12 between the platen roller 13 and the thermal head 1, and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. With this, load of the platen roller 13 is applied to the thermal head 1 through the thermal paper 12.

The heat dissipation plate 15 is a plate-shaped member made of a metal such as aluminum, a resin, ceramics, glass, or the like, and serves for fixation and heat dissipation of the thermal head 1.

Figure 2:
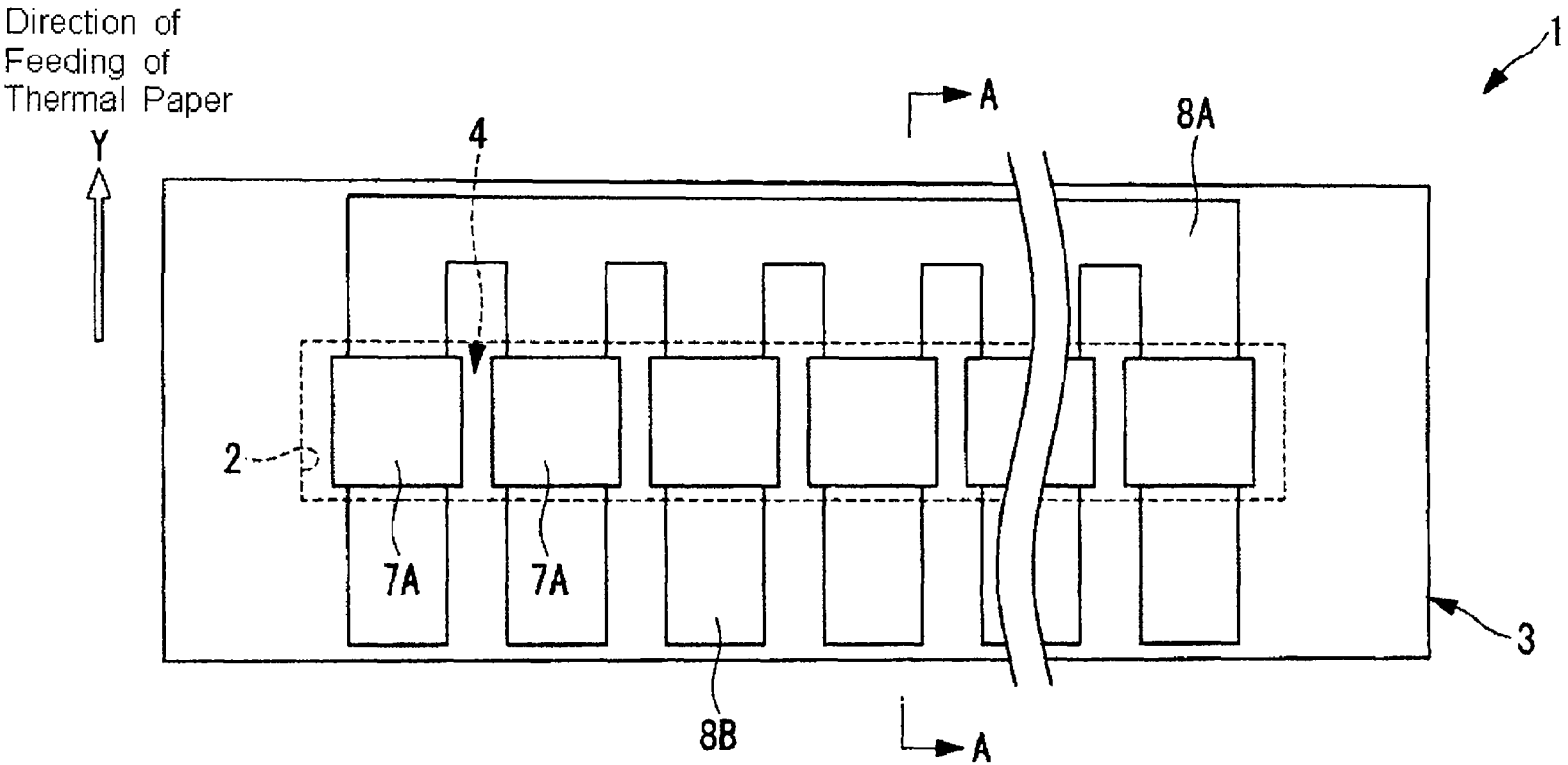
FIG. 2 is a plan view illustrating a thermal head of FIG. 1 viewed from a protective film side.

As illustrated in FIG. 2, in the thermal head 1, a plurality of heating resistor layers 7 and electrode portions 8A and 8B are arranged in a longitudinal direction of a support substrate 3. The arrow Y indicates a direction in which the thermal paper 12 is fed by the paper feeding mechanism 17. In a top surface of the support substrate 3, there is formed a rectangular concave portion 2 extending in the longitudinal direction of the support substrate 3.

Figure 3:
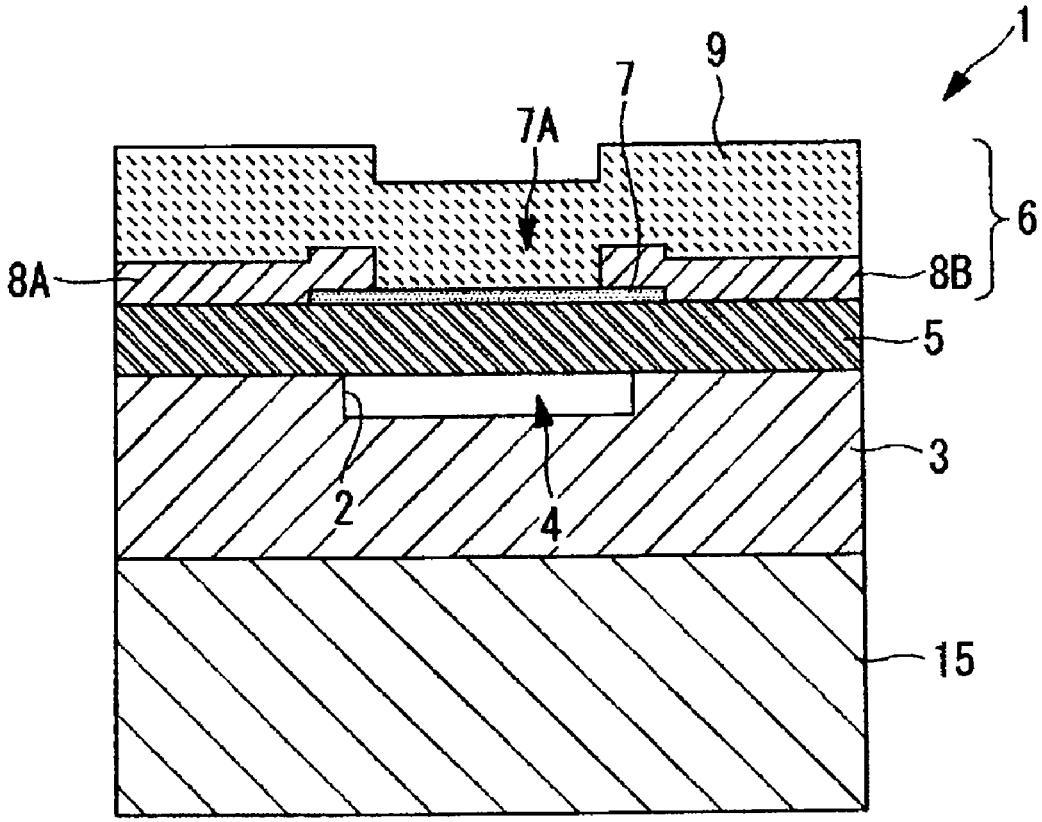
FIG. 3 is a cross-sectional view (vertical cross-sectional view) of the thermal head taken along the arrow A-A of FIG. 2.

A cross-sectional view taken along the arrow A-A of FIG. 2 is illustrated in FIG. 3.

As illustrated in FIG. 3, the thermal head 1 includes the support substrate 3 having a flat-plate shape and fixed onto the heat dissipation plate 15, an upper plate substrate 5 having a flat-plate shape and bonded onto the top surface of the support substrate 3, and heating resistors 6 including the plurality of heating resistor layers 7 provided on the upper plate substrate 5, the electrode portions 8A and 8B connected to the heating resistor layers 7, and a protective film 9 covering the heating resistor layers 7 and the electrode portions 8A and 8B to protect the heating resistor layers 7 and the electrode portions 8A and 8B from abrasion and corrosion.

The support substrate 3 is, for example, an insulating substrate such as a glass substrate or a silicon substrate having a thickness of approximately 300 μm to 1 mm. In the top surface of the support substrate 3, that is, the boundary surface of the upper plate substrate 5, the rectangular concave portion (opening) 2 extending in the longitudinal direction of the support substrate 3 is formed. The concave portion 2 is a cavity having, for example, a depth of about 1 μm to 150 μm, and a width of about 50 μm to 300 μm.

The upper plate substrate 5 is formed of, for example, a glass material having a thickness of about 10 μm to 100 μm, and functions as a heat accumulating layer which accumulates therein heat generated from the heating resistor layers 7. The upper plate substrate 5 is bonded to the top surface of the support substrate 3 so as to seal the concave portion 2. With the concave portion 2 being covered with the upper plate substrate 5, a hollow portion 4 is formed between the upper plate substrate 5 and the support substrate 3.

The hollow portion 4 has a connecting-through configuration opposing each of the heating resistor layers 7, and functions as a hollow heat insulating layer which inhibits heat generated from the heating resistor layers 7 from being propagated from the upper plate substrate 5 to the support substrate 3. By allowing the hollow portion 4 to function as the hollow heat insulating layer, an amount of heat which is propagated to a portion located above the heating resistor layers 7 and used for printing or the like may be adjusted to a value larger than an amount of heat propagated to the support substrate 3 via the upper plate substrate 5 located under the heating resistor layers 7, and an improvement in thermal efficiency of the thermal head 1 may be achieved.

The heating resistor layers 7 are each provided so as to straddle the concave portion 2 in its width direction on an upper end surface of the upper plate substrate 5, and are arranged at predetermined gaps in the longitudinal direction of the concave portion 2. In other words, each of the heating resistor layers 7 is provided to be opposed to the hollow portion 4 through the upper plate substrate 5 so as to be located above the hollow portion 4.

The electrode portions 8A and 8B cause the heating resistor layers 7 to generate heat, and are formed of a common electrode 8A connected to one end of each of the heating resistor layers 7 in a direction orthogonal to the arrangement direction of the heating resistor layers 7, and individual electrodes 8B connected to the other ends of the heating resistor layers 7, respectively. The common electrode 8A is integrally connected to all the heating resistor layers 7, and the individual electrodes 8B are connected to the heating resistor layers 7, respectively.

When voltage is selectively applied to the individual electrodes 8B, current flows through the heating resistor layers 7 connected to the selected individual electrodes 8B and the common electrode 8A opposed thereto, with the result that the heating resistor layers 7 generate heat. In this state, the thermal paper 12 is pressed by the operation of the pressure mechanism 19 against the surface portion (printing portion) of the protective film 9 covering the heating portions of the heating resistor layers 7, with the result that color is developed on the thermal paper 12 and printing is performed.

Note that, of each of the heating resistor layers 7, an actually heating portion (hereinafter, referred to as "heating portion 7A") is a portion of each of the heating resistor layers 7 on which the electrode portions 8A and 8B do not overlap, that is, a portion of each of the heating resistor layers 7 which is a region between the connecting surface of the common electrode 8A and the connecting surface of each of the individual electrodes 8B and is located substantially directly above the hollow portion 4.

Hereinafter, a manufacturing method for the thermal head 1 structured as described above is described using FIGS. 4 to 7.

Figure 4:
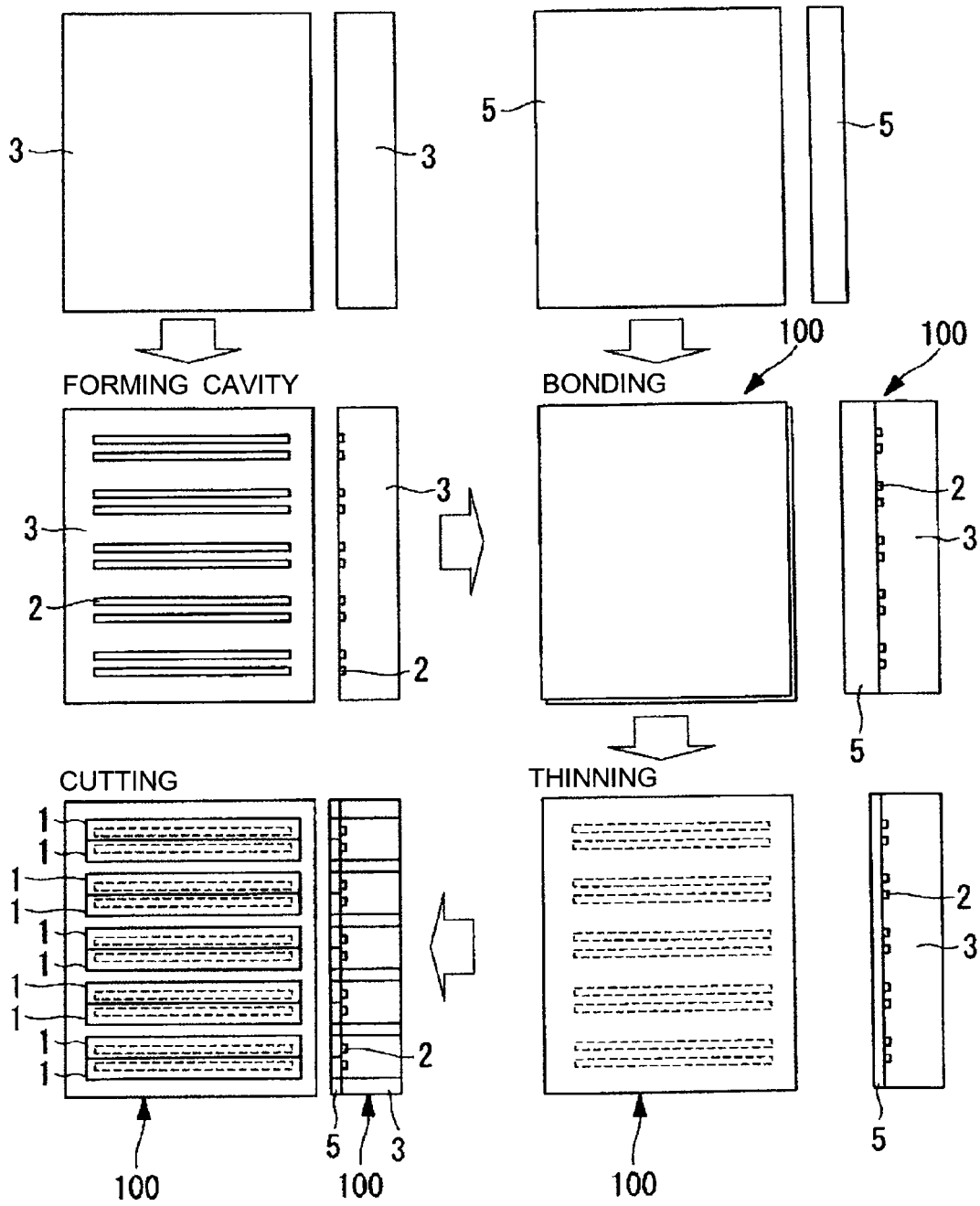
FIG. 4 is a flow chart illustrating a method of manufacturing the thermal head of FIG. 1.

As illustrated in FIG. 4, the manufacturing method for the thermal head 1 according to this embodiment includes a cavity forming step (opening forming step) of forming the concave portions 2 in the top surface of the support substrate 3, a bonding step of bonding the top surface of the support substrate 3 to a back surface of the upper plate substrate 5, a thinning step (surface processing step) of processing the surface of the upper plate substrate 5 bonded to the support substrate 3 to form a thin plate, a resistor forming step (not shown) of forming the heating resistors 6 on a top surface of the upper plate substrate 5, and a cutting step of cutting a substrate (hereinafter, referred to as "laminated substrate") 100, which is the bonded substrate on which the heating resistors 6 are formed. Each of the steps described above is specifically described hereinbelow.

First, in the cavity forming step, in the top surface of the support substrate 3, the concave portion 2 is formed so as to be opposed to a region in which the heating resistor layers 7 are formed. The concave portion 2 is formed in the top surface of the support substrate 3 by performing, for example, sandblasting, dry etching, wet etching, or laser machining.

When the sandblasting is performed on the support substrate 3, the top surface of the support substrate 3 is covered with a photoresist material, and the photoresist material is exposed to light using a photomask of a predetermined pattern, to thereby cure a portion other than the region in which the concave portion 2 is formed.

After that, by cleaning the top surface of the support substrate 3 and removing the photoresist material which is not cured, etching masks (not shown) having etching windows formed in the region in which the concave portion 2 is formed may be obtained. In this state, the sandblasting is performed on the top surface of the support substrate 3, and the concave portion 2 having a depth of about 1 to 150 μm is formed. It is desirable that the depth of the concave portion 2 be, for example, 10 μm or more and half or less of the thickness of the support substrate 3.

Further, when etching, such as the dry etching and the wet etching, is performed, as in the case of the sandblasting, the etching masks are formed, which have the etching windows formed in the region in the top surface of the support substrate 3 in which the concave portion 2 is formed. In this state, by performing the etching on the top surface of the support substrate 3, the concave portion 2 having the depth of about 1 to 150 μm is formed.

Such an etching process employs, for example, the wet etching using hydrofluoric acid-based etchant or the like, or the dry etching such as reactive ion etching (RIE) and plasma etching. Note that, as a reference example, in the case of a single-crystal silicon support substrate, the wet etching is performed, which uses the etchant such as tetramethylammonium hydroxide solution, KOH solution, or a mixed solution of hydrofluoric acid and nitric acid.

Next, in the bonding step, the back surface of the upper plate substrate 5 as a glass substrate having a thickness of, for example, about 300 to 700 μm is bonded to the top surface of the support substrate 3 formed with the concave portions 2 by fusion bonding, anodic bonding, or direct bonding. By bonding and bringing the support substrate 3 and the upper plate substrate 5 into stacked relation, the concave portions 2 formed in the support substrate 3 are covered with the upper plate substrate 5 so that the hollow portions 4 are formed between the support substrate 3 and the upper plate substrate 5.

As to the upper plate substrate 5, a substrate having a thickness of not more than 100 μm is difficult to manufacture and handle, and also costly. Accordingly, instead of directly bonding an upper plate substrate, which is originally thin, to the support substrate 3, the upper plate substrate 5 having a thickness which allows easy manufacturing and handling thereof is first bonded to the support substrate 3 in the bonding step, and then the upper plate substrate 5 is processed into a desired thickness in the thinning step.

In the thinning step, the upper plate substrate 5 of the laminated substrate 100 is etched or mechanically polished to be processed into a thin plate.

Specifically, the top surface of the upper plate substrate 5 is processed so as to thin the upper plate substrate 5 to a desired thickness of 10 to 100 μm, and provide a surface roughness which allows a heating resistor 6 to be formed on the top surface, specifically a surface roughness of not less than 0.1 nm.

Examples of a method for adjusting the surface roughness include polishing using ceric oxide or colloidal silica, wet etching using hydrofluoric acid or a mixture of hydrofluoric acid and nitric acid, dry etching, blasting, and sputtering using argon or oxygen.

A processing method for allowing the top surface of the upper plate substrate 5 to be finished with a desired surface roughness may also be a method other than a processing method for thickness adjustment. That is, it is possible that processing for thickness adjustment may be performed by lapping using abrasion grains, and processing for roughness adjustment may be performed by polishing. Alternatively, it is also possible that processing for thickness adjustment may be performed by lapping using abrasion grains, and processing for roughness adjustment may be performed by wet etching.

Figure 5:
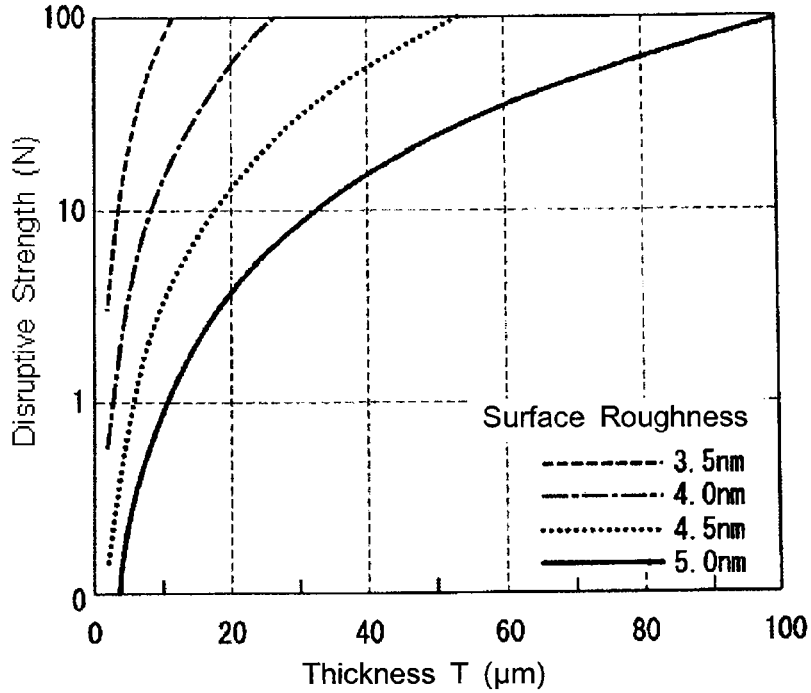
FIG. 5 is a graph illustrating the relationship between the thickness and disruptive strength of an upper plate substrate.
Figure 6:
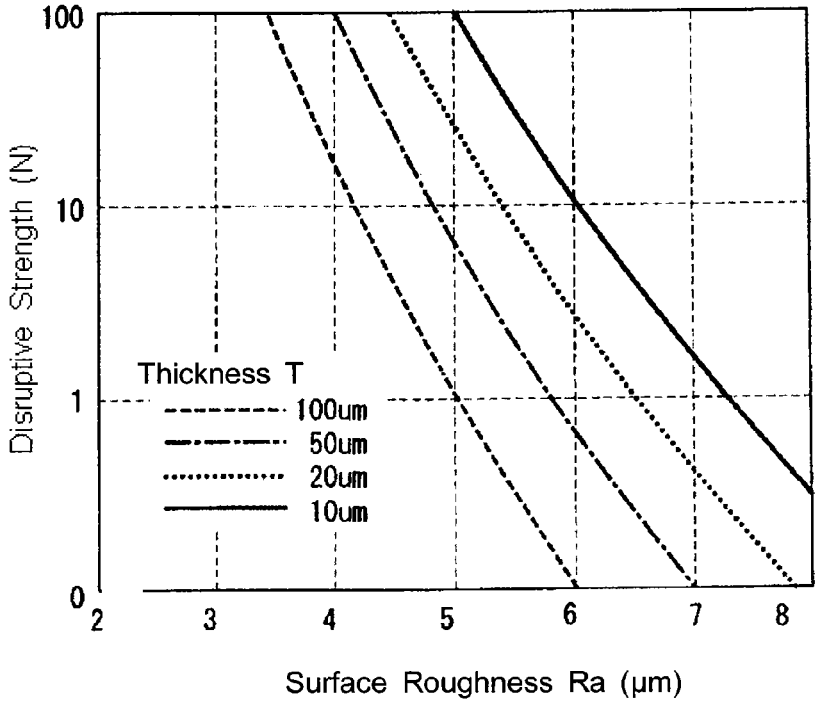
FIG. 6 is a graph illustrating the relationship between the surface roughness and disruptive strength of the upper plate substrate.

Here, a description is given of the relationship between the thickness or surface roughness of the upper plate substrate 5 and the disruptive strength thereof using FIGS. 5 and 6. FIGS. 5 and 6 illustrate, by way of example, the relationships between the thickness and surface roughness of the upper plate substrate 5 and the disruptive strength thereof when the groove width of the hollow portion 4 is 0.2 mm, and the groove length thereof is 50 mm.

The relationship between the thickness and disruptive strength of the upper plate substrate 5 when the surface roughness of the upper plate substrate 5 is varied is illustrated in FIG. 5. In FIG. 5, the abscissa represents the thickness (μm) of the upper plate substrate 5, and the ordinate represents the disruptive strength (N) thereof.

The relationship between the surface roughness and disruptive strength of the upper plate substrate 5 when the thickness of the upper plate substrate 5 is varied is illustrated in FIG. 6. In FIG. 6, the abscissa represents the surface roughness (nm) of the upper plate substrate 5, and the ordinate represents the disruptive strength (N) thereof.

If consideration is given to a load applied from the platen roller 13 to the upper plate substrate 5 in the thermal printer 10, a strength required of the upper plate substrate 5 is not less than about 100 N in the examples illustrated in FIGS. 5 and 6. Accordingly, as illustrated in FIG. 5, it may be seen that, when the thickness of the upper plate substrate 5 is, e.g., 20 μm, the surface roughness of the upper plate substrate 5 should be adjusted to be not more than about 4 nm and, when the thickness of the upper plate substrate 5 is, e.g., 50 μm, the surface roughness of the upper plate substrate 5 should be adjusted to be not more than about 4.5 nm.

When such a thermal head 1 is used in the thermal printer 10 illustrated in FIG. 1, a load is constantly applied from the platen roller 13 to the upper plate substrate 5, and the pressure thereof is approximately 0.1 MPa. In addition, when a hard and small foreign matter enters the gap between the platen roller 13 and the thermal paper 12 or between the thermal paper 12 and the thermal head 1, a pressure several tens of times the normal pressure is applied to the upper plate substrate 5 immediately under the foreign matter. Consequently, a stress is concentrated on a scratch or a defect in the top surface of the upper plate substrate 5, and may destroy the upper plate substrate 5.

Accordingly, based on the results of FIGS. 5 and 6, the relationship between the thickness T (mm) and surface roughness Ra (mm) of the upper plate substrate 5 which allows the upper plate substrate 5 to withstand a pressure of 10 MPa is determined in consideration of a safety factor 100 times that for the normal pressure, and the foregoing expression (1) is obtained:

$$Ra \leq \log_e(T^2)/(3\times10^6)+6.5\times10^{-6} \quad (1).$$

Figure 7:
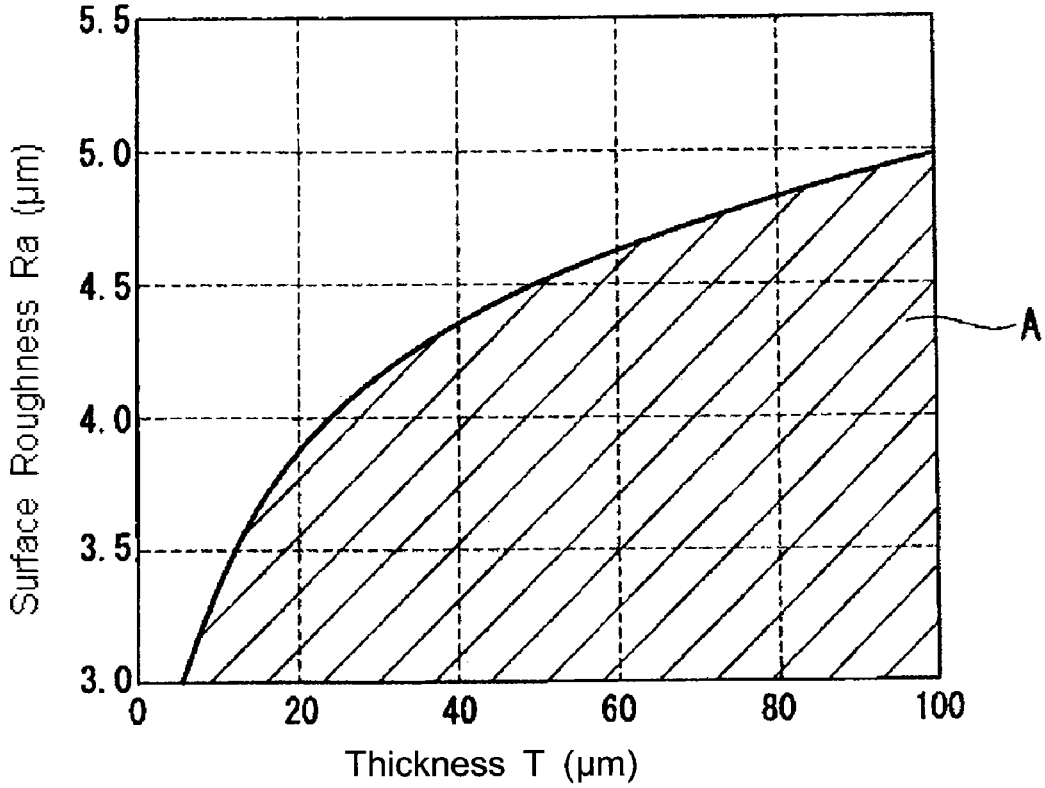
FIG. 7 is a graph illustrating the relationship between the thickness and surface roughness of the upper plate substrate.

The relationship between the surface roughness Ra and thickness T of the upper plate substrate 5 represented by the foregoing expression (1) is illustrated in FIG. 7. In FIG. 7, the abscissa represents the thickness (μm) of the upper plate substrate 5, and the ordinate represents the surface roughness (nm) of the upper plate substrate 5. That is, the upper plate substrate 5 which satisfies the foregoing expression (1) has the surface roughness Ra and the thickness T which belong to the region A of FIG. 7. Specifically, when the thickness of the upper plate substrate 5 is, e.g., 100 μm, it is necessary to adjust the surface roughness of the upper plate substrate 5 to a value of less than 5 nm.

Next, over the regions of the laminate substrate 100 thus thinned which oppose the concave portions 2 in the top surface of the upper plate substrate 5, the heating resistor layers 7, the common electrode 8A, the individual electrodes 8B, and the protective film 9 are successively formed to form the heating resistors 6. The heating resistor layers 7, the common electrode 8A, the individual electrodes 8B, and the protective film 9 may be formed using a known manufacturing method for the conventional thermal head.

Specifically, a thin film made of a Ta-based or silicide-based heating resistor material is deposited on the upper plate substrate 5 using a thin-film formation process such as sputtering, chemical vapor deposition (CVD), or vapor deposition. By forming the thin film of the heating resistor material using a lift-off process, an etching process, or the like, the heating resistor layers 7 each having a desired shape are formed.

Subsequently, in the same manner as in the heating resistor forming step, a wiring material such as Al, Al—Si, Au, Ag, Cu, or Pt is deposited on the upper plate substrate 5 by sputtering, vapor deposition, or the like. Then, after forming the film using a lift-off process or an etching process and screen-printing the wiring material, sintering or the like is performed to form the common electrode 8A and the individual electrodes 8B each having a desired shape. Note that the heating resistor layers 7, the common electrode 8A, and the individual electrodes 8B may be formed in an arbitrary order.

In the patterning of a resist material for the lift-off or etching process for forming the heating resistor layers 7 and the electrode portions 8A and 8B, a photoresist material is patterned using a photomask.

After the heating resistor layers 7, the common electrode 8A, and the individual electrodes 8B are formed, a protective film material such as $SiO_2$, $Ta_2O_5$, SiAlON, $Si_3N_4$, or diamond-like carbon is deposited by sputtering, ion plating, a CVD process, or the like to form the protective film 9, thereby forming the heating resistors 6.

In this case, the top surface of the upper plate substrate 5 has been processed to have a surface roughness of not less than 0.1 nm so that the heating resistors 6 each including the heating resistor layer 7 and the protective film 9 may be formed easily on the top surface of the upper plate substrate 5.

The laminate substrate 100 thus formed with the heating resistors 6 is cut in the direction in which the concave portions 2 extend in the cutting step, to thereby manufacture the plurality of thermal heads 1 illustrated in FIGS. 2 and 3.

As described above, in the method of manufacturing the thermal heads 1 according to this embodiment, the concave portions 2 are formed in the top surface of the support substrate 3 in the cavity forming step, and the back surface of the upper plate substrate 5 is bonded to the top surface of the support substrate 3 in the bonding step so as to bring the upper plate substrate 5 and the support substrate 3 into stacked relation. Then, in the thinning step, the top surface of the upper plate substrate 5 is processed to thin the upper plate substrate 5, and in the resistor forming step, the heating resistors 6 are formed on the regions of the top surface of the upper plate substrate 5 which oppose the concave portions 2. In this manner, at the positions opposing the heating resistor layers 7, the thermal heads 1 having the hollow portions 4 between the support substrate 3 and the upper plate substrate 5 are formed.

In each of the thermal heads 1 thus formed, the upper plate substrate 5 provided with the heating resistor 6 functions as a heat accumulating layer which accumulates therein heat generated from the heating resistor layer 7. The concave portion 2 formed in the top surface of the support substrate 3 forms the hollow portion 4 between the support substrate 3 and the upper plate substrate 5 when the support substrate 3 and the upper plate substrate 5 are bonded together. The hollow portion 4 is formed in the region opposing the heating resistor layer 7, and functions as a heat insulating layer which shuts off heat generated from the heating resistor layer 7. Therefore, in the thermal head 1 according to this embodiment, it is possible to inhibit heat generated from the heating resistor layer 7 from being propagated to the support substrate 3 via the upper plate substrate 5 and dissipated, and improve the use ratio of heat generated from the heating resistor layer 7, i.e., the thermal efficiency of the thermal head 1.

Moreover, in such a thermal head 1, the top surface of the upper plate substrate 5 is processed so as to satisfy the foregoing expression (1), and hence a predetermined strength (10 MPa) may be assured.

Specifically, by adjusting the surface roughness of the upper plate substrate 5 to a value of less than 5 nm, the strength of the upper plate substrate 5 may be ensured.

In the resistor forming step, by forming the heating resistors 6 on the top surface of the upper plate substrate 5 having a surface roughness of not less than 0.1 nm by sputtering, the adhesion of the protective film 9 and the heating resistor layers 7 which are formed over the upper plate substrate 5 may be improved.

The thermal printer 10 according to this embodiment includes the thermal head 1 described above so that the thermal efficiency of the thermal head 1 may be improved, and the amount of energy required for printing may be reduced. In addition, even when a foreign matter is trapped between the thermal paper 12 and the upper plate substrate 5, the upper plate substrate 5 may be prevented from being broken.

While the embodiment of the present invention has been described thus far in detail with reference to the drawings, a specific structure thereof is not limited to the embodiment. Design modifications and the like within the scope not departing from the gist of the present invention are encompassed therein.

For example, in the embodiment described above, the concave portions 2 each having the rectangular shape extending in the longitudinal direction of the support substrate 3 are formed, and each of the hollow portions 4 has the connecting-through configuration opposing all the heating resistor layers 7. Instead, it is also possible that mutually independent concave portions may be formed at positions opposing the respective heating portions 7A of the heating resistor layers 7 and along the longitudinal direction of the support substrate 3, and mutually independent hollow portions may be formed by the upper plate substrate 5 for the individual concave portions on a one-to-one basis. This allows the formation of thermal heads each including a plurality of independent hollow heat insulating layers.

The description has also been given assuming that the concave portions 2 are formed in the top surface of the support substrate 3. However, the concave portions 2 may also be formed in the back surface of the upper plate substrate 5, or formed in each of the top surface of the support substrate 3 and the back surface of the upper plate substrate 5. Instead of forming the concave portions 2, through holes formed in the top surface of the support substrate 3 may be provided.

What is claimed is:

1. A method of manufacturing a thermal head, comprising:

forming an opening in at least one of a top surface of a support substrate having a flat-plate shape and a back surface of an upper plate substrate having a flat-plate shape;

bonding the back surface of the upper plate substrate to the top surface of the support substrate formed with the opening so as to bring the upper plate substrate and the support substrate into stacked relation;

processing a top surface of the upper plate substrate bonded to the support substrate to thin the upper plate substrate to a thickness T; and forming a heating resistor on a region of the processed top surface of the upper plate substrate which opposes the opening, wherein the processing comprises processing the top surface of the upper plate substrate so that a roughness Ra of the top surface of the upper plate substrate satisfies the following expression (1):

$$Ra \leqq \log_e(T^2)/(3\times10^6)+6.5\times10^{-6} \quad (1).$$

2. A method according to claim 1, wherein the processing comprises processing the top surface of the upper plate substrate to have a roughness which allows the heating resistor to be formed.

3. A method according to claim 1, wherein the processing comprises processing the top surface of the upper plate substrate to have a roughness of 0.1 nm or more and less than 5 nm.

4. A method according to claim 1, wherein the processing comprises etching the upper plate substrate.

5. A method according to claim 1, wherein the processing comprises polishing the upper plate substrate.

6. A method according to claim 1, wherein the forming a heating resistor comprises forming the heating resistor in the region opposing the opening by sputtering.

7. A thermal head, comprising:

a support substrate having a flat-plate shape;

an upper plate substrate having a flat-plate shape and a back surface bonded to a top surface of the support substrate; and a heating resistor formed on a top surface of the upper plate substrate, wherein:

at least one of the top surface of the support substrate and the back surface of the upper plate substrate has an opening formed on a region which opposes the heating resistor; and the top surface of the upper plate substrate is processed so that a roughness Ra of the top surface of the upper plate substrate satisfies the following expression (1) which is a function of a thickness T of the upper plate substrate:

$$Ra \leqq \log_e(T^2)/(3\times10^6)+6.5\times10^{-6} \quad (1).$$

8. A printer, comprising the thermal head according to claim 7.

* * * * *